US007187776B2

(12) United States Patent
Bachmann et al.

(10) Patent No.: US 7,187,776 B2
(45) Date of Patent: Mar. 6, 2007

(54) PLANAR LOUDSPEAKER

(75) Inventors: Wolfgang Bachmann, Nagel (DE); Gerhard Krump, Schwarzach (DE); Hans-Jürgen Regl, Regensburg (DE); Andreas Ziganki, Mettmann (DE)

(73) Assignee: Harman Becker Automotive Systems GmbH, Karlsbad (DE)

( * ) Notice: Subject to any disclaimer, the term of this patent is extended or adjusted under 35 U.S.C. 154(b) by 0 days.

(21) Appl. No.: 10/483,719

(22) PCT Filed: Jul. 13, 2001

(86) PCT No.: PCT/EP01/08104

§ 371 (c)(1),
(2), (4) Date: Aug. 9, 2004

(87) PCT Pub. No.: WO03/013186

PCT Pub. Date: Feb. 13, 2003

(65) Prior Publication Data

US 2005/0031155 A1 Feb. 10, 2005

(51) Int. Cl.
*H04R 25/00* (2006.01)

(52) U.S. Cl. ..... 381/152; 381/431

(58) Field of Classification Search ..... 381/152, 381/190, 191, 396, 398, 431
See application file for complete search history.

(56) References Cited

U.S. PATENT DOCUMENTS

| | | | | |
|---|---|---|---|---|
| 5,701,359 | A | 12/1997 | Guenther et al. | 381/203 |
| 6,275,598 | B1 | 8/2001 | Bachmann et al. | 381/425 |
| 6,622,817 | B1 | 9/2003 | Bachmann et al. | 181/150 |
| 6,925,191 | B2 * | 8/2005 | Petroff et al. | 381/431 |
| 6,956,957 | B1 * | 10/2005 | Azima et al. | 381/431 |

FOREIGN PATENT DOCUMENTS

| | | |
|---|---|---|
| DE | 19940930 | 3/2001 |
| EP | 1052879 | 11/2000 |
| JP | 2000050384 | 2/2000 |
| WO | WO 99/52322 | 10/1999 |

* cited by examiner

*Primary Examiner*—Suhan Ni
(74) *Attorney, Agent, or Firm*—O'Shea, Getz & Kosakowski, P.C.

(57) ABSTRACT

The invention relates to a planar loudspeaker comprising a light, thin soundboard (2) which may be energized to produce multiply-reflected bending waves, a surrounding frame (3) holding the soundboard (2) in an articulated, shear-resistant manner; at least one driver (6, 7, 9, 10) connected to the soundboard (2) to energize the soundboard (2); and at least one bridge (13, 16, 18, 20, 22, 25), rigidly connecting the at least one driver (6, 7, 9, 10) to the frame (3), wherein the bridge or at least one of the bridges (13, 16, 18, 20, 22, 25) is connected to the damping board (14).

7 Claims, 7 Drawing Sheets

PLANAR LOUDSPEAKER

CLAIM OF PRIORITY.

This patent application claims priority to International Application PCT/EP01/08104 filed on Jul. 13, 2001.

FIELD OF THE INVENTION.

This invention relates to the field of loudspeakers, and in particular to a planar loudspeaker comprising a light, thin soundboard that may be energized to produce multiple-reflected bending waves. A surrounding frame holds this board in an articulated manner, At least one driver is connected to and energizes the soundboard, and at least one bridge rigidly connects the at least one driver to the frame.

RELATED ART

U.S. Pat. No. 5,701,359 discloses a rigid-panel-type loudspeaker that functions on the principle of a free piston, wherein the sound-radiating surface (e.g., a diaphragm) is rigid (e.g., like a piston). The sound-radiating surface does not effect any significant flexural vibrations in the operating frequency range, and the rigid panel provided as the sound-radiating surface is free (i.e., open and not enclosed by a cabinet in an airtight manner).

WO 97/09842 discloses multiresonance loudspeakers, wherein weakly attenuated bending waves occurring in the operating frequency range are reflected at the panel edges such that the diaphragm becomes a multiresonator in response to the formation of standing waves. Such multiresonance loudspeakers are also referred to as "multiresonance soundboards", "bending-wave loudspeakers" or "distributed mode speakers." In multiresonance loudspeakers the panel is usually also independent (i.e., not a component of a closed box).

The remaining types of electrodynamic panel drivers (see, for example, DE 199 409 30) may in principle be fixed to the panel in a floating design (i.e., without being supported by a frame). The mass of the magnet system then forms the dynamic counter-support for the application of force to the panel to be driven (principle of "seismic mass").

If the panel is driven in such a way that the panel normal is oriented approximately vertically relative to gravity, then the heavy magnet systems of the drivers apply gravitational force to the panel through their crimps. Due to the low rigidity of the crimps, these undergo a creeping settling motion over time in response to gravity, thereby causing an eccentrically acting, irreversible misalignment of the voice coils. Although a settling of this type also occurs even in horizontal assemblies, such as in cover panels, the settling direction here is not in an eccentric (radial) direction but in the direction of the voice coil axis.

In order to prevent this destructive, eccentric creeping effect, the drivers in vertically operating planar loudspeakers are attached to so-called "bridges" in such a way that their weight is unable to exert any shear force on the panel. These bridges (also referred to as "traverses," or "gantries") are attached to frames, which in turn support the panel by its rim in a shear-resistant articulated manner.

Due to their relatively large span, a bridge of this type usually acts like a flat spring that forms a low-damping, spring-mass vibrational system. In the resonance frequency located in the bass range, this vibrational system (bridge resonator) exerts strong deflections without radiating any noticeable sound. The strong deflections in bridge resonance are able to overload the voice coil centering and ultimately destroy the driver.

Therefore, there is a need for a planar loudspeaker with protection against settling in which the dynamic side-effects of this settling protection are avoided.

SUMMARY

A planar loudspeaker includes a bridge that is connected to a damping board. The bridge supports a driver and the damping board. The damping board is preferably rigid.

The bridge resonance frequency may be tuned here by, for example, adjusting mass. Specifically, the bridge resonance may be determined by the ratio of the spring constant to the total bridge mass including all elements attached to it. Independently of the damping provided by the board surface of the damping board, the mass may be modified by changing the thickness or the density of the damping board in such a way that the radiative contribution of the damping board integrates in a positive manner into the acoustic spectrum of the multiresonance loudspeaker.

In an example of an alternative approach, the bridge resonance frequency may be tuned by adjusting the spring. Independent of the damping provided by the board surface, the planar moment of inertia, and thus the spring constant, may, for example, be adjusted by modifying the cross-sectional profile of the bridge in such a way that the resonance zone of the bridge integrates in a positive manner into the acoustic spectrum of the multiresonance loudspeaker.

In a preferred approach, at least one bridge is created in the form of an air-permeable rigid frame. The at least one bridge may, however, also be created in the form of an airtight flat box cover.

The damping board preferably has a smaller area than the soundboard. In addition, a preferred approach implements the damping board using a light, extremely flexurally rigid sandwich construction. A sandwich construction of this type is known, for example, from EP 0 924 959.

In addition, the connection points between the bridge(s) and damping board may be located in the region of the node lines for the first two vibrational modes of the damping board. The damping board itself may also be an integral component of the at least one bridge.

The at least one bridge may be composed of a prismatic rod, wherein the bridge does not completely cover the area opposite the soundboard provided by the frame. In addition, the at least one bridge may be created in the form of a regular lattice and/or perforated panel.

In another modification of the invention, the at least one bridge may be elastically compliant and an integral component of an airtight flat box in which all external components of this flat box are themselves airtight, as well as interconnected in an airtight manner. The flat box here may have a bass reflex port (or also a bass reflex tube). At least one bridge may be in the form of a rigid panel and be connected to the damping board by a surrounding bridge crimp.

A chamber may also be attached to the flat box, wherein the chamber may also have a bass reflex port (or also a bass reflect tube). Alternatively, the chamber may also be airtight. In addition, the chamber may also have a passive radiator. In terms of its acoustic effect, the planar loudspeaker according to the invention may also be an asymmetric two-panel loudspeaker since the principal front soundboard facing the listener forms an acoustic multiresonance soundboard, while the smaller rear damping board facing away from the listener is, acoustically speaking, a rigid panel.

The degree of damping here may be directly adjusted by the surface area of the damping board. The larger the board, the greater the damping. Additional enhancement of the low-frequency sound radiation by the planar loudspeaker may be achieved by designing the damping board as a rigid panel, thereby not only damping the bridge resonance vibration but also simultaneously contributing to sound radiation in the low-frequency range. In free multiresonance soundboards, the low-frequency range is always degraded by a dipole short circuit. The additional sound radiation partially compensates this dipole short circuit.

A particular advantage of the asymmetrical two-panel loudspeaker relates to its simple driving technology. Whereas known monopole drivers (see DE 198 218 62) are composed of back-to-back single drivers, alternative side-by-side single drivers, or complex double voice-coil systems, a loudspeaker according to an aspect of the invention requires only at least one known conventional panel driver.

If the frame supporting the bridge(s) and soundboard is acoustically open, then in response to a counter-acting pumping motion of the two panels, the compressed or decompressed air flows through the frame openings so as to equalize the pressure. If alternatively, however, the frame is sealed such that the soundboard and damping board create radiative surfaces of an otherwise closed flat box, then the two panels work in a counter-acting manner in the low-frequency range. The arrangement of the two panels then forms a "low-frequency monopole radiator," that is, a breathing sphere with partially inactive zones.

A preferred embodiment of such a flat-box arrangement ventilates the box in a controlled manner. To this end, one or more bass reflex ports are provided through which the interior air is able to exit in phase so as to obtain an improvement in the bass response. The ventilation of the flat box simultaneously avoids the negative effect of excessively rigid air compliance.

In another preferred embodiment, the seal of the rigid damping board, located in the plane of the rear flat-box wall and originally not provided to effect sound radiation, may be in the form of an extended flat spring, thereby achieving an enlarged radiative surface along with an accompanying increase in radiative damping. This extended flat spring detunes the spring constant of the original bridge, a factor which must be considered during resonance tuning.

An advantage of the invention includes the fact that a settling protection that exhibits almost no damaging dynamic side-effects is able to be realized with relatively little complexity and expense. In addition, the implementation according to the invention generates an additional acoustic radiation in an otherwise inadequately provided bass frequency range.

Other systems, methods, features and advantages of the invention will be, or will become, apparent to one with skill in the art upon examination of the following figures and detailed description. It is intended that all such additional systems, methods, features and advantages be included within this description, be within the scope of the invention, and be protected by the following claims.

DESCRIPTION OF THE DRAWING

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
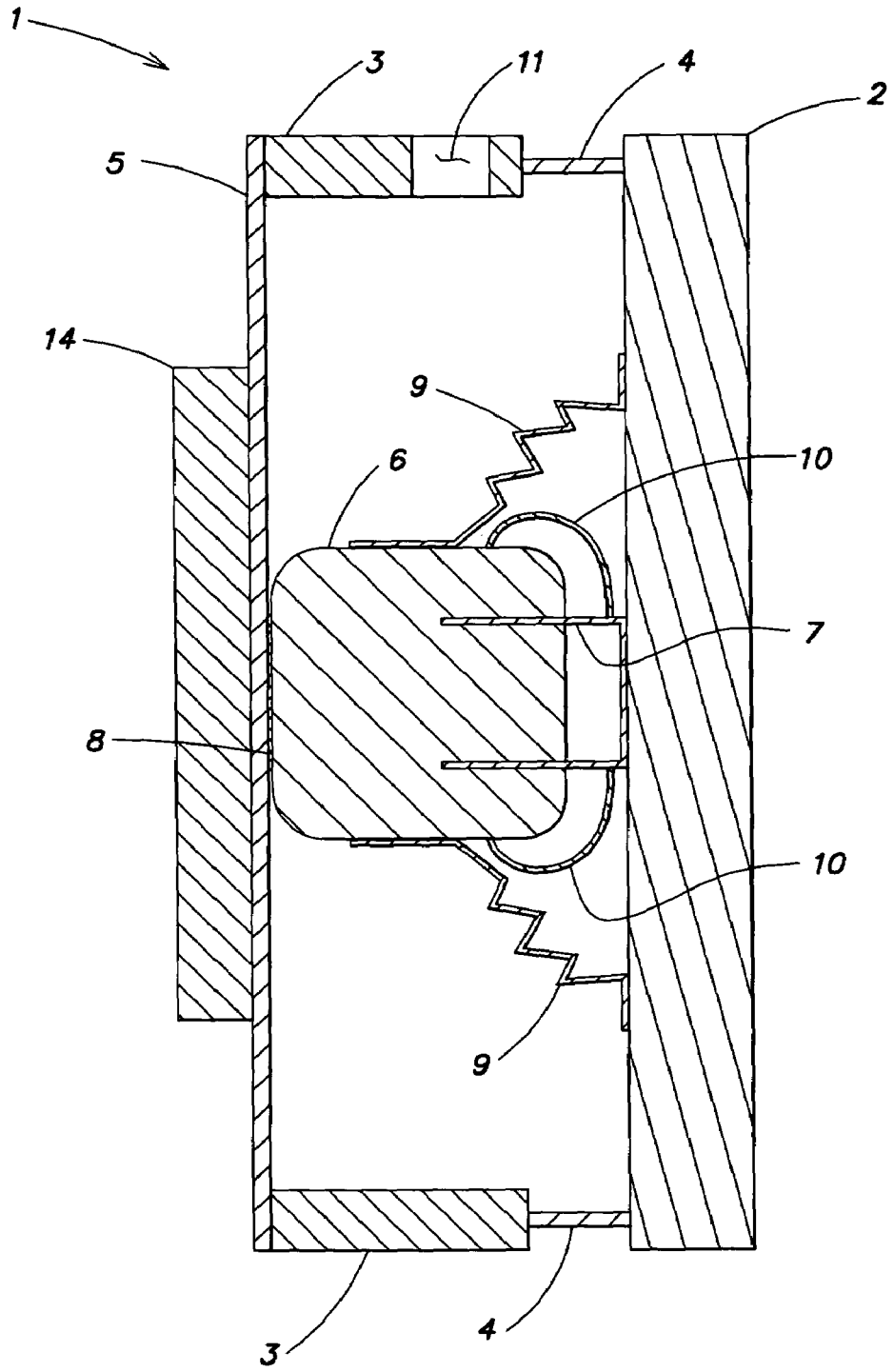
FIG. 1 is cross sectional illustration of a first embodiment of a planar loudspeaker in the form of a free, asymmetrical two-panel loudspeaker in which the damping board is attached to one bridge.

FIG. 1 illustrates a first embodiment of a planar loudspeaker 1. The loudspeaker is configured as a asymmetrical two-panel loudspeaker, that includes a multi-resonance soundboard 2 that provides a diaphragm. The soundboard 2 has a relatively low mass, high bending stiffness, low bending-wave damping, and a self-supporting frame attachment. A rigid, usually surrounding frame 3 holds the soundboard 2 by a surrounding panel support 4, which acts as a shear-resistant articulated joint. A bridge 5 in the form, for example, of a narrow prismatic rod is connected laterally (or at the back) to the frame by a rigid connection 8 to a magnet system 6 of a driver, and simultaneously at the ends opposite the magnet. This carries the static load of the magnet system 6. A voice coil 7 passing through the annular gap of the magnet system 6 is centered by an internal crimp 10 relative to the magnet system 6 and at the same time attached to the soundboard 2. An external crimp 9 holds the static load of the magnet system 6 during assembly of the loudspeaker. It also functions as a floating magnet attachment so as to allow horizontal operation. In a multi-resonance planar loudspeaker with essentially free support, the frame 3 and/or bridge 5 contain openings 11 (gaps) that provide for pressure equalization of the otherwise enclosed air.

The asymmetrical two-panel loudspeaker 1 also includes a damping board 14 that is attached to the bridge 5 and opposite soundboard 2. The large planar surface of the damping board 14 is aligned in a plane roughly parallel to the large planar surface of the soundboard 2.

Figure 2:
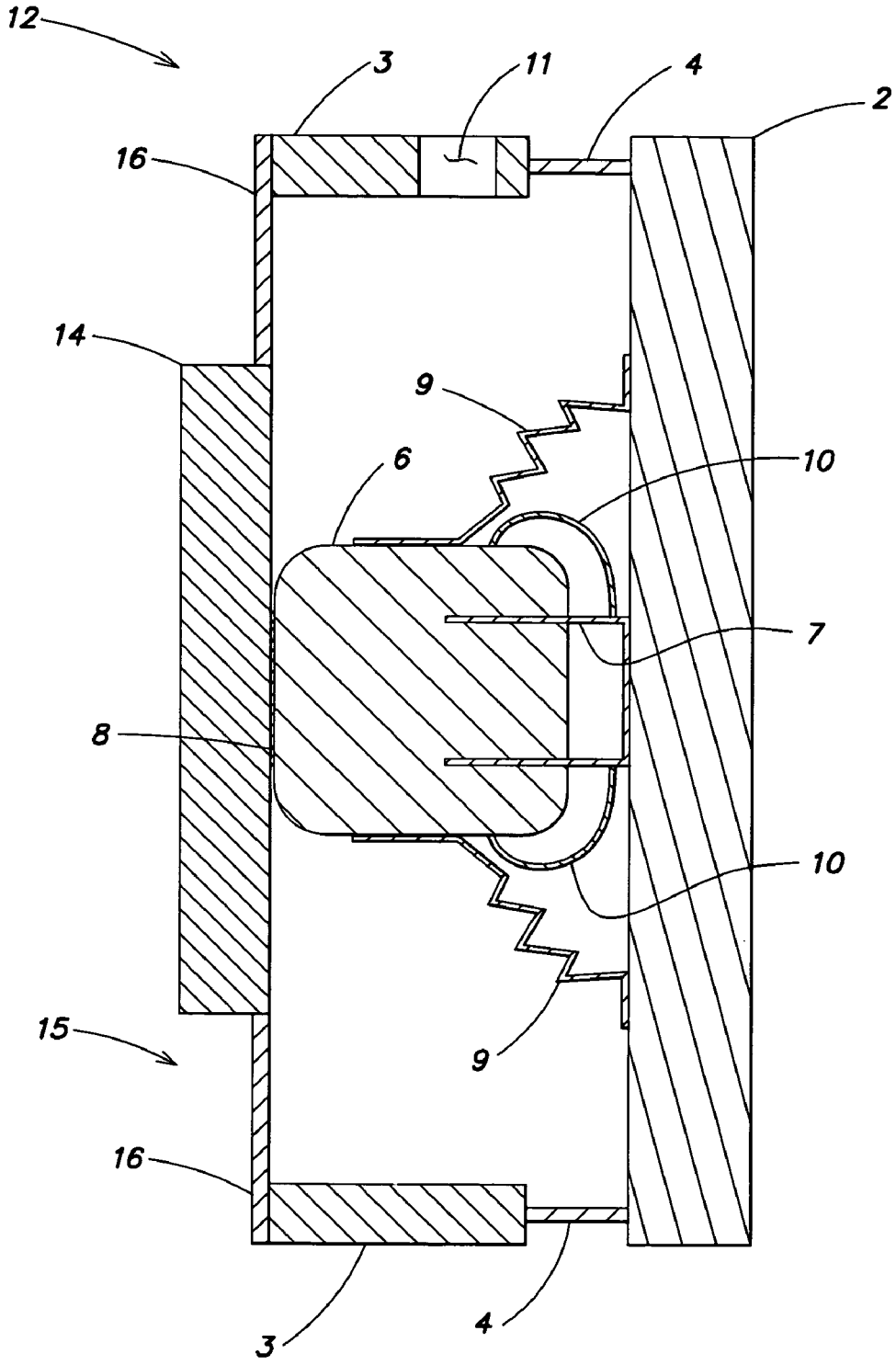
FIG. 2 is a cross sectional illustration of a second embodiment of a planar loudspeaker in the form of a free, asymmetrical two-panel loudspeaker in which the damping board takes on part of the bridge function.

FIG. 2 is a cross-sectional illustration of a second planar loudspeaker 12 configured as a free, asymmetrical two-panel loudspeaker. A damping board 14 is attached directly to the magnet system 6. Relatively short bridge rods 16 connect the damping board 14 to the frame 3. The damping board 14 represents a widened part of the bridge 15 formed from the bridge rods 16, and thus performs the function of the bridge 15 to relieve static load. The large planar surface of the damping board 14 is aligned in a plane roughly parallel to the orientation of the large planar surface of the soundboard 2. In terms of the remaining elements, the embodiment of FIG. 2 matches the embodiment shown in FIG. 1.

Figure 3:
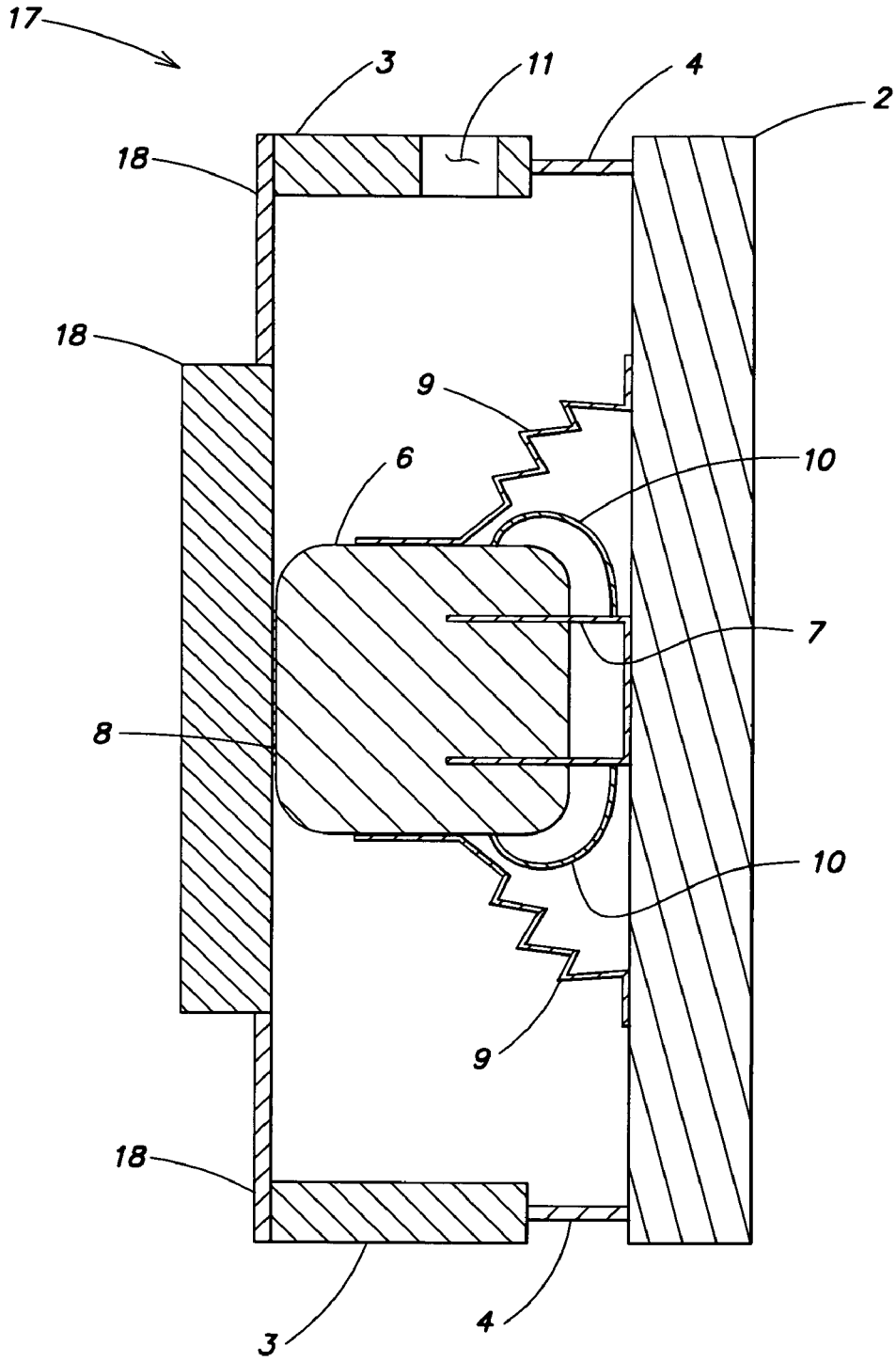
FIG. 3 is a cross sectional illustration of a third embodiment of a planar loudspeaker in the form of a free, asymmetrical two-panel loudspeaker in which the bridge rods emulate a disk spring.

FIG. 3 is a cross sectional illustration of a third embodiment of a planar loudspeaker 17 configured as a free, asymmetrical two-panel loudspeaker. In contrast to the embodiment of FIG. 2, in this embodiment the bridge rods 16 have been replaced by a surrounding disk spring 18. The static function of the disk spring 18 is the same as that for the rods 16 in FIG. 2—with a different resulting acoustic behavior, however. The soundboard 2 is shielded from the possible presence of a nearby wall of a building, thereby providing a helpful remedy against the undesirable "wall effect".

Figure 4:
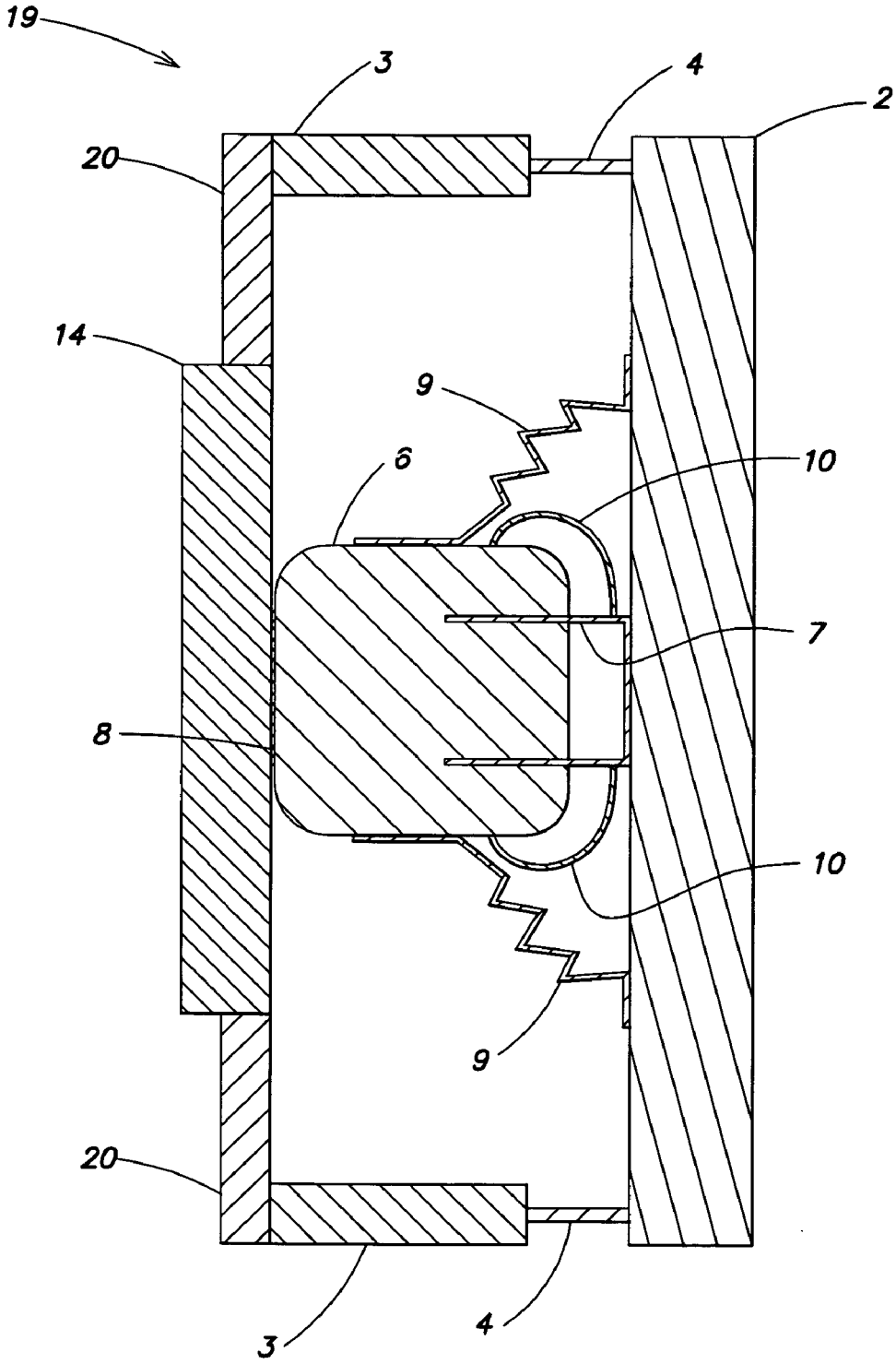
FIG. 4 is a cross sectional illustration of a fourth loudspeaker embodiment in the form of a closed, asymmetrical two-panel loudspeaker.

FIG. 4 is a cross sectional illustration of a fourth loudspeaker embodiment configured as a asymmetrical two-panel loudspeaker 19. Notably, this embodiment is configured and arranged as a closed, asymmetrical two-panel loudspeaker. This embodiment is similar to the embodiment of FIG. 3, with the principal exception that this embodiment does not include the ventilation openings 11 of the embodiment of FIG. 3. In addition, in the embodiment illustrated in FIG. 4, a rear cover 20, which acts as a disk spring, does not have any pores or openings. The compliance produced by the rear cover 20 is significantly hardened by the compressive elasticity of the enclosed air.

Figure 5:
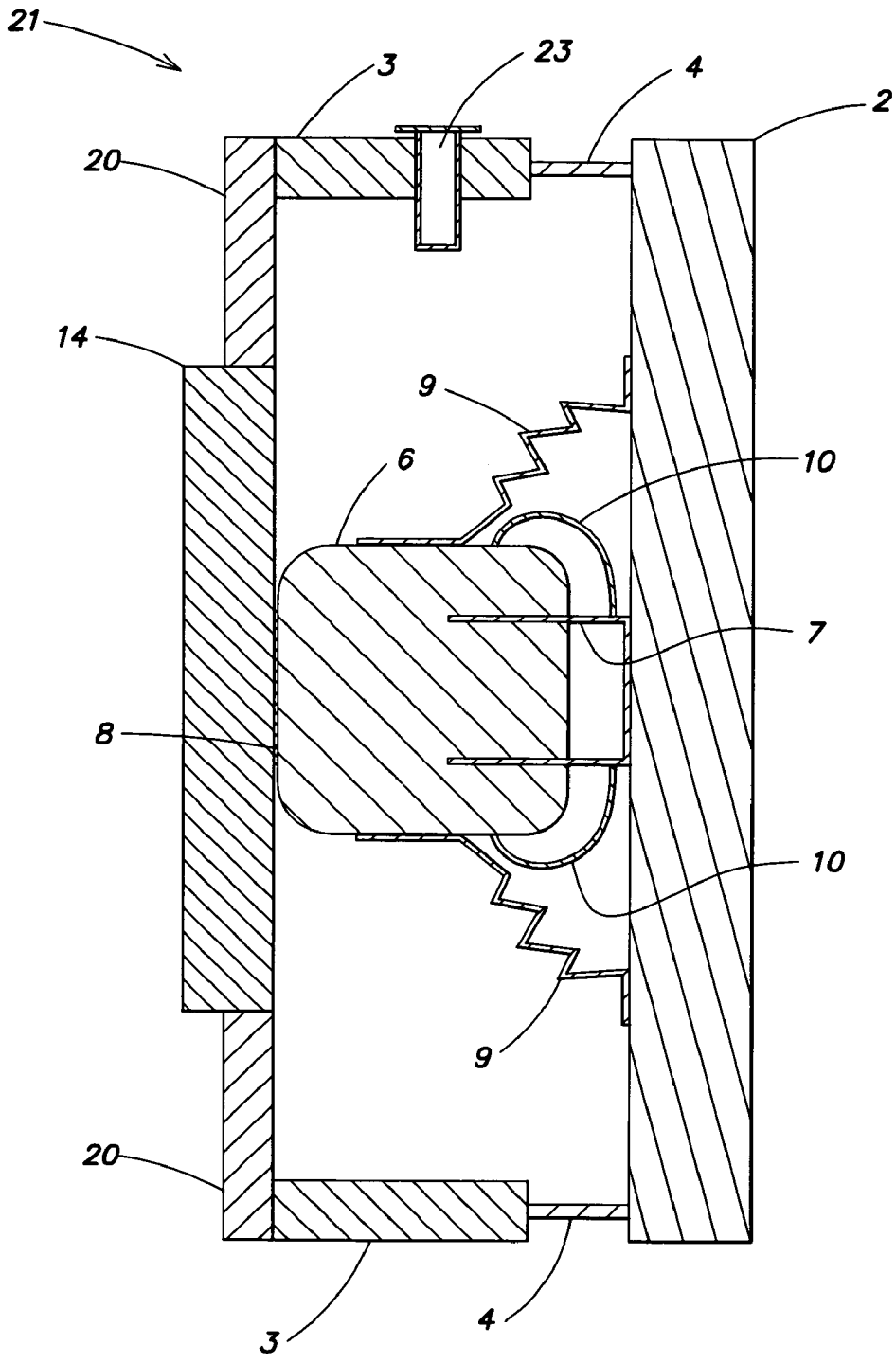
FIG. 5 is a cross sectional illustration of a fifth embodiment of a planar loudspeaker in the form of a closed, asymmetrical two-panel loudspeaker with a bass reflex port.

FIG. 5 is a cross-sectional illustration of a planar loudspeaker configured and arranged as an asymmetrical two-panel bass reflex loudspeaker 21. In contrast to the embodiment of FIG. 4, one bass reflex tube 23 is inserted into an opening in the frame 3. This approach provides an additional means, beyond the bridge resonance, of providing a tunable, low-frequency filling-in of the response spectrum.

Figure 6:
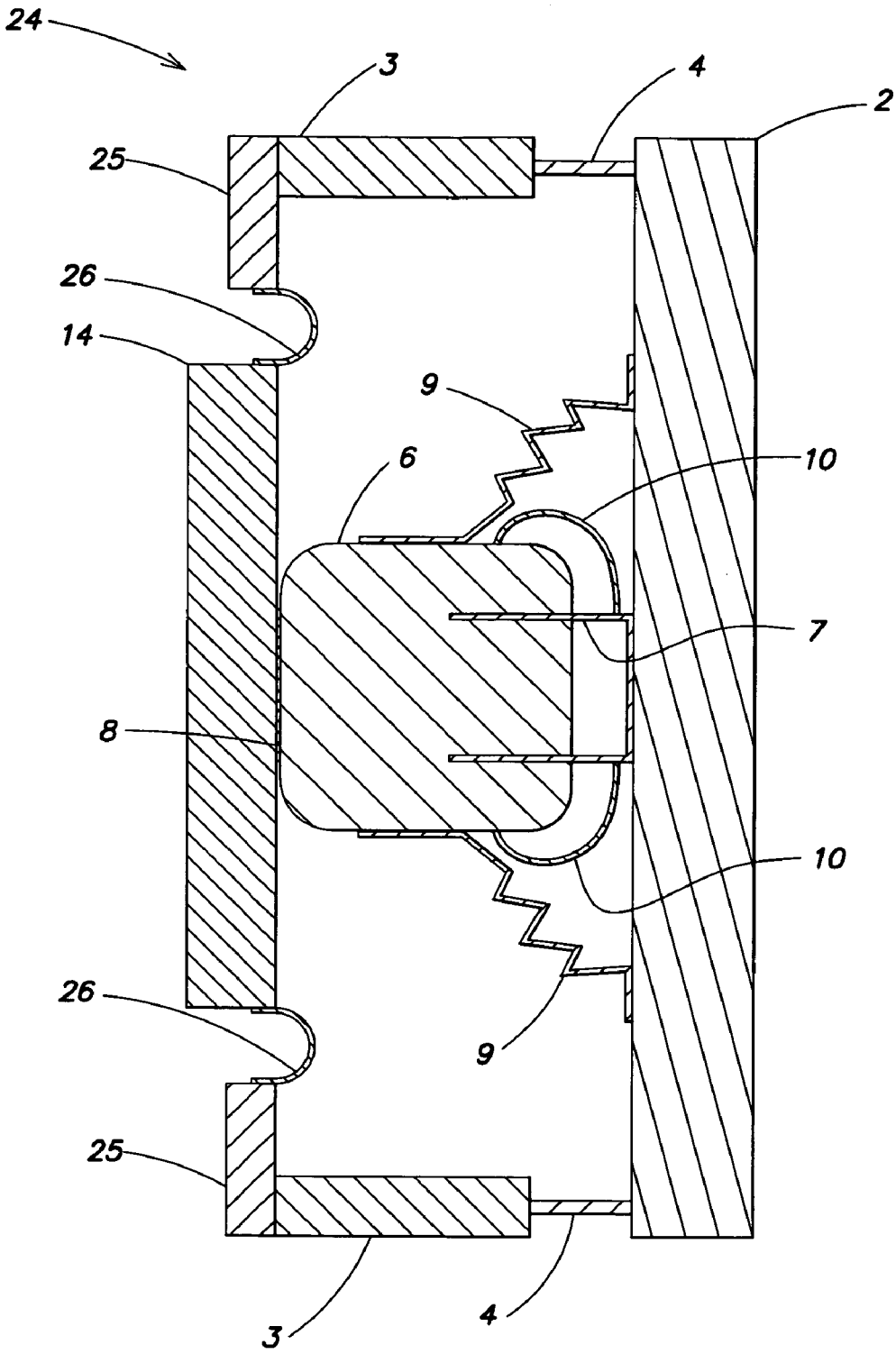
FIG. 6 is a cross sectional illustration of a sixth embodiment of a planar loudspeaker in the form of a closed, asymmetrical two-panel loudspeaker with a rigid panel bridge and bridge crimp.

FIG. 6 is a cross sectional illustration of an embodiment of a planar loudspeaker configured as a closed, asymmetrical two-panel loudspeaker 24 with a rigid panel bridge 25 and a bridge crimp 26. The damping board 14 is resonantly connected to the panel bridge 25 through the bridge crimp 26. The panel bridge 25 is connected to the frame 3.

Figure 7:
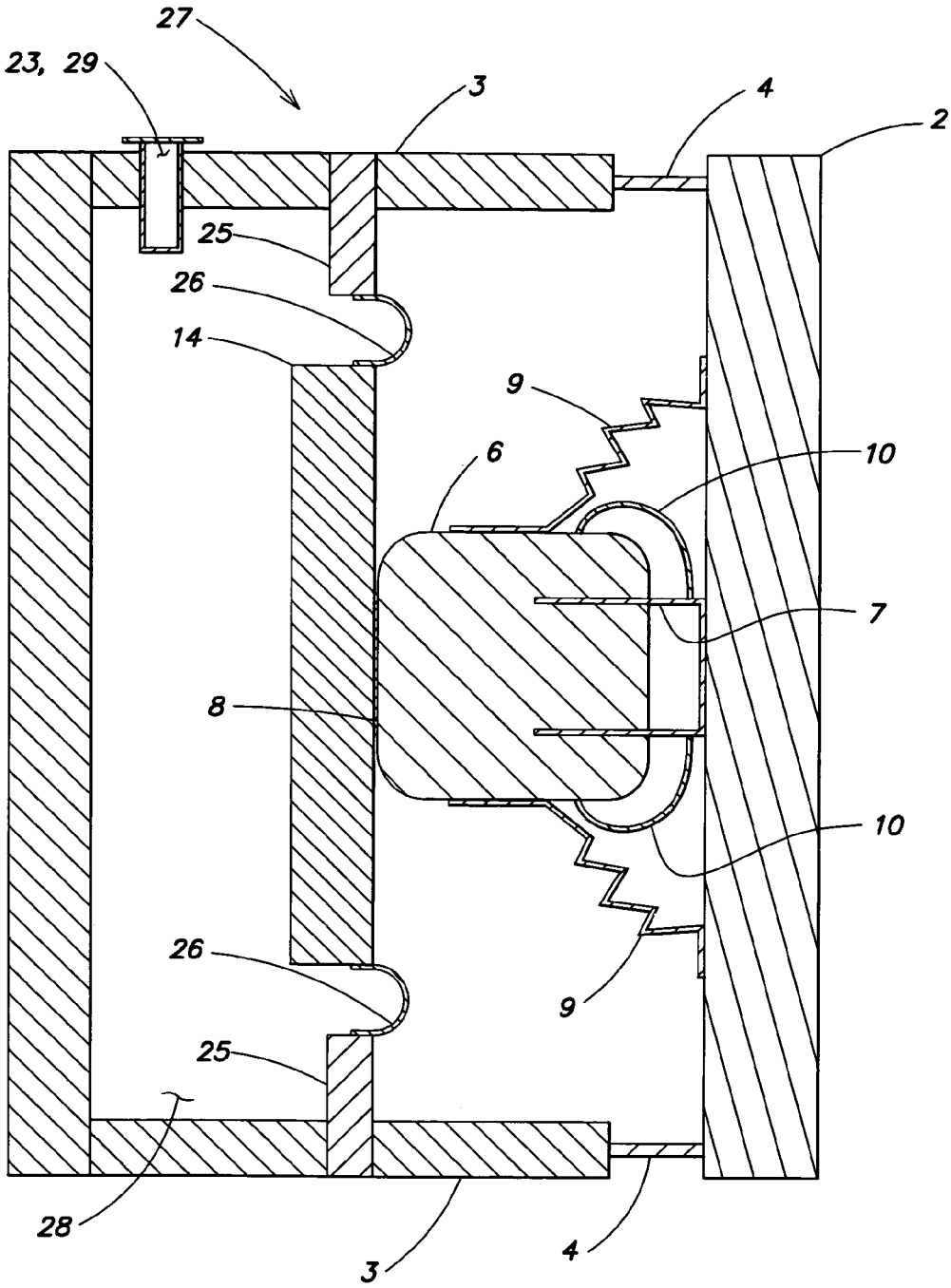
FIG. 7 is a cross sectional illustration of a seventh embodiment of a planar loudspeaker in the form of a closed, asymmetrical two-panel loudspeaker with two chambers, as well as a rigid panel bridge, bridge crimp, and bass reflex port.

FIG. 7 is a cross sectional illustration of an embodiment of a planar loudspeaker configured as a closed, asymmetrical two-panel two-chamber loudspeaker 27. The embodiment illustrated in FIG. 7 is substantially the same as the embodiment illustrated in FIG. 6 with the principal exception that in this embodiment the loudspeaker 27 includes a second chamber 28, in addition to the rigid panel bridge 25 and the bridge crimp 26. The second chamber 28 includes a bass reflex tube 23. The second chamber 28 here is added on to the rear side of two-panel two-chamber loudspeaker 27, in other words, to the side of two-panel two-chamber loudspeaker 27 including damping board 14.

Instead of using a bass reflex tube 23, the second chamber 28 may be closed, or have a passive radiator 29.

The illustrations have been discussed with reference to functional blocks identified as modules and components that are not intended to represent discrete structures and may be combined or further sub-divided. In addition, while various embodiments of the invention have been described, it will be apparent to those of ordinary skill in the art that other embodiments and implementations are possible that are within the scope of this invention. Accordingly, the invention is not restricted except in light of the attached claims and their equivalents.

What is claimed is:

1. A planar loudspeaker, comprising:

a soundboard that creates reflected bending waves when energized;

a frame;

a panel support that connects the soundboard to the frame in an articulated shear-resistant manner;

a driver that energizes the soundboard;

a crimp that connects the driver to the soundboard;

a bridge having first and second ends and an interior side and an exterior side, where the driver is connected to the interior side of the bridge, and the first and second ends connect to the frame; and a damping board connected to the exterior side of the bridge.

2. The planar loudspeaker of claim 1, where the damping board is rigid.

3. The planar loudspeaker of claim 1, where the bridge comprises an air-permeable rigid frame.

4. The planar loudspeaker of claim 1, where a surface area of the damping board is smaller than a surface area of the soundboard.

5. The planar loudspeaker of claim 1, where the damping board comprises sandwich construction.

6. The planar loudspeaker of claim 1, where a plurality of connection points between the bridge and the damping board are located in a region of a plurality of node lines of first two vibrational modes of the damping board.

7. The planar loudspeaker of claim 2, where the damping board comprises an integral component of the bridge.

* * * * *

UNITED STATES PATENT AND TRADEMARK OFFICE

CERTIFICATE OF CORRECTION

PATENT NO. : 7,187,776 B2
APPLICATION NO. : 10/483719
DATED : March 6, 2007
INVENTOR(S) : Bachmann et al.

It is certified that error appears in the above-identified patent and that said Letters Patent is hereby corrected as shown below:

Column 2
Line 64, delete “according”
Line 65, delete “to the invention”

Column 3
Line 51, delete “according to the invention”

Column 4
Line 4, before “cross-sectional” insert --a--
Line 55, before “bridge” insert --the--
Line 64, before “damping” delete “A” and insert --The--
Line 67, delete “bridge 15” and insert --bridge 5--

Signed and Sealed this

Eighth Day of May, 2007

JON W. DUDAS
*Director of the United States Patent and Trademark Office*